United States Patent [19]

Hagen

[11] 4,168,103

[45] Sep. 18, 1979

[54] DRAWER-LOCK DEVICE

[76] Inventor: Magnus F. Hagen, 434 Panorama Dr., Laguna Beach, Calif. 92651

[21] Appl. No.: 947,348

[22] Filed: Oct. 2, 1978

[51] Int. Cl.[2] ..... E05B 65/46

[52] U.S. Cl. ..... 312/219; 312/333

[58] Field of Search ..... 312/219, 218, 216, 217, 312/220, 221, 222, 333; 70/85

[56] References Cited

U.S. PATENT DOCUMENTS

| | | | |
|---|---|---|---|
| 2,966,384 | 12/1960 | Bergman | 312/218 |
| 3,767,280 | 10/1973 | McLaughlin | 312/219 |

FOREIGN PATENT DOCUMENTS

| | | | |
|---|---|---|---|
| 2240643 | 10/1975 | France | 312/220 |

*Primary Examiner*—Mervin Stein
*Assistant Examiner*—Alexander Grosz
*Attorney, Agent, or Firm*—Francis X. LoJacono

[57] ABSTRACT

A drawer-lock device that simultaneously locks multiple drawers from one activation point only, wherein the device can be actuated by a centrally located lock mechanism or by a lock mechanism located on either the side of a pedestal of a desk or of a cabinet. The lock device comprises an actuator member having an elongated rod which is operably connected at one or both ends to a crank arm, whereby the rotational movement of the connecting rod is transferred into a linear movement for the spring-loaded lever arm, the lever arm being interconnected to a vertically disposed lift bar, wherein the lift bar includes one or more locking tabs that are adjustable to correspond to each spring loaded keeper member mounted to the respective drawers thereof, wherein the locking tabs are positioned on the vertical lift bar for locking engagement with the keeper members.

15 Claims, 10 Drawing Figures

FIG. 1
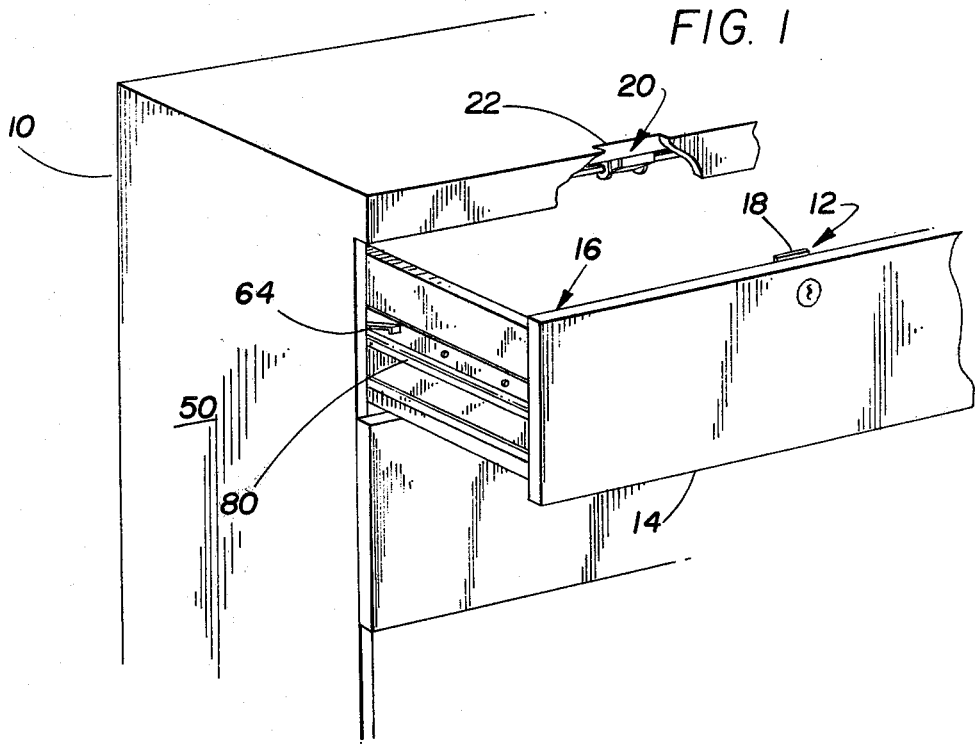
FIG. 2
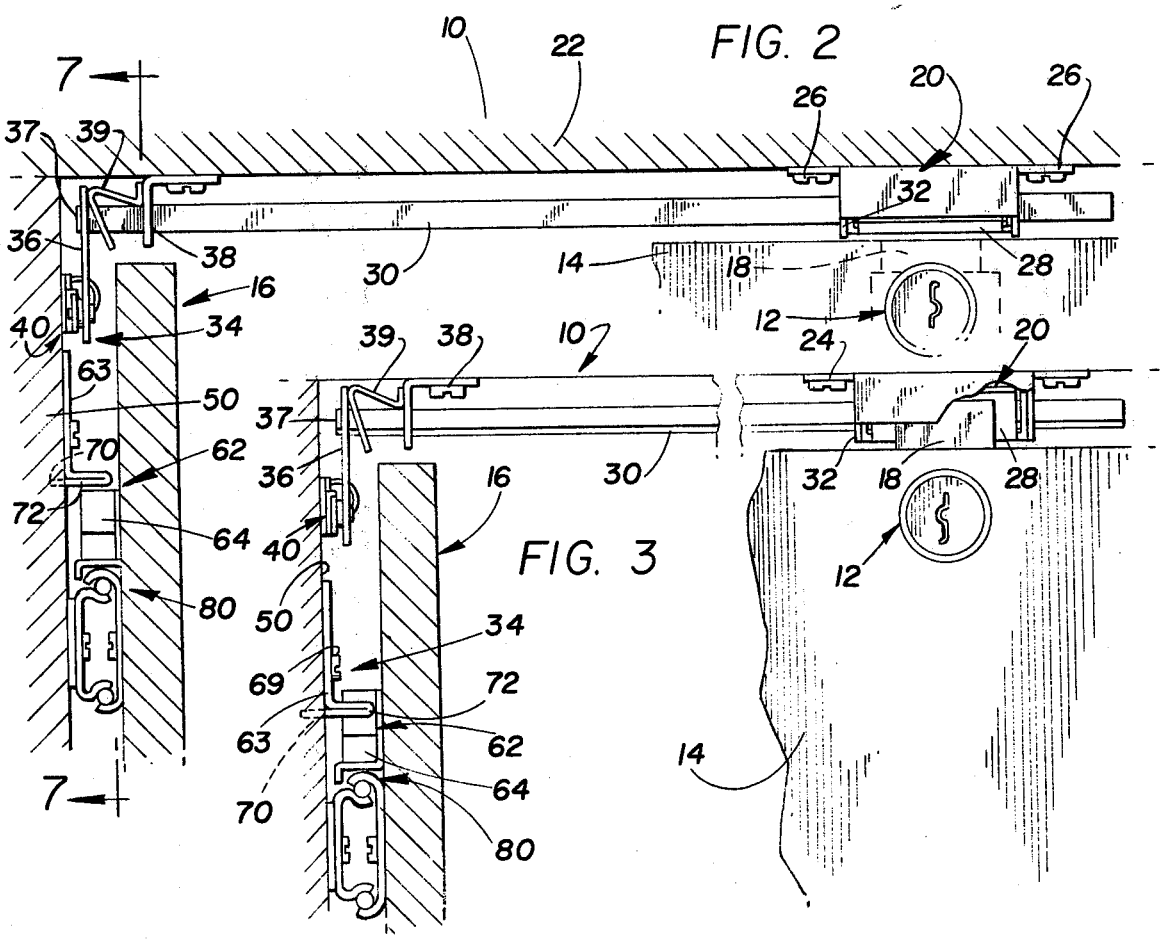
FIG. 3

FIG. 4
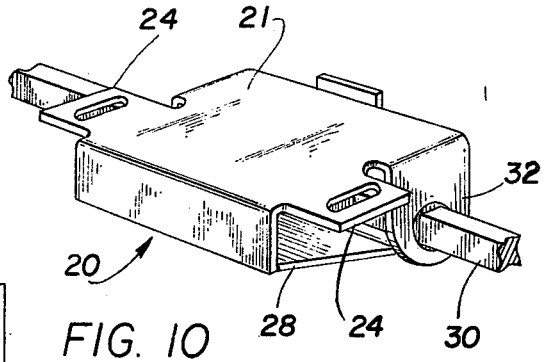
FIG. 10
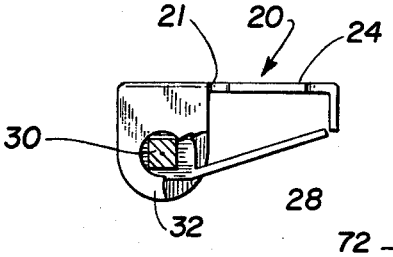
FIG. 5
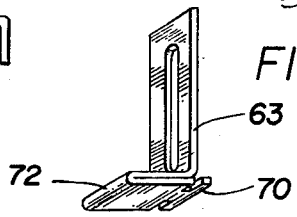
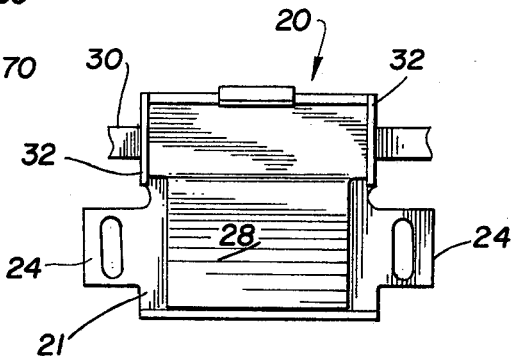
FIG. 6
FIG. 7
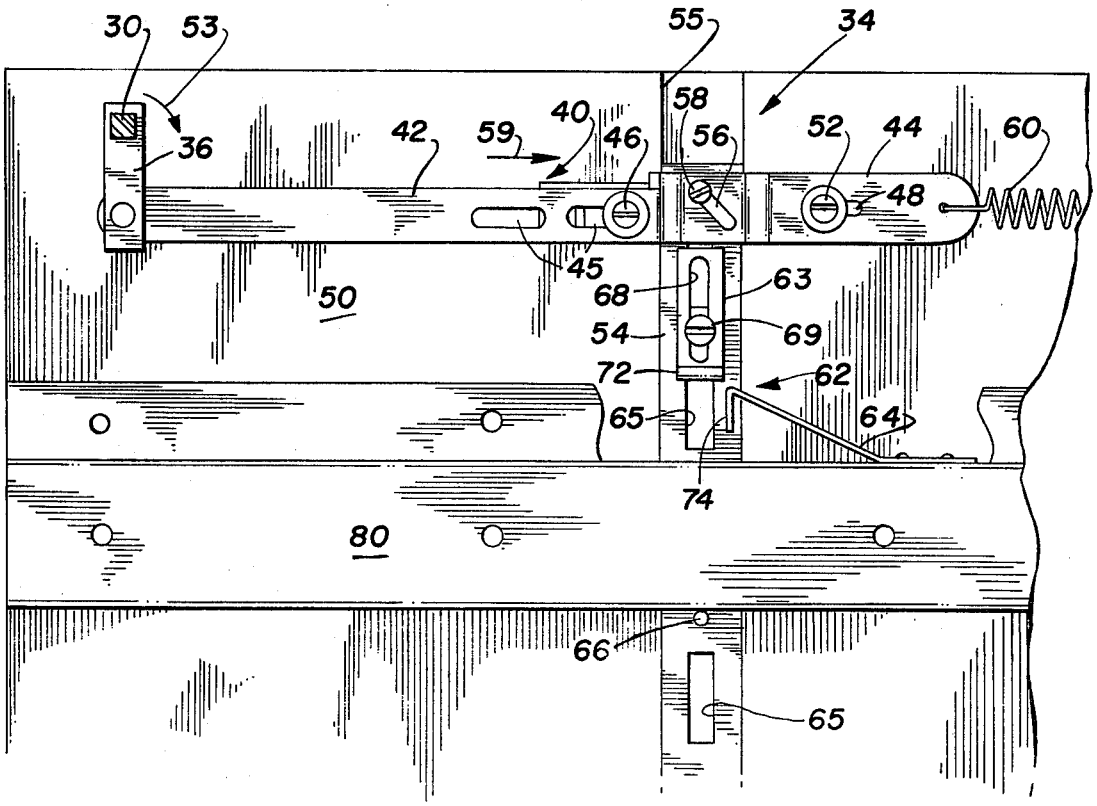

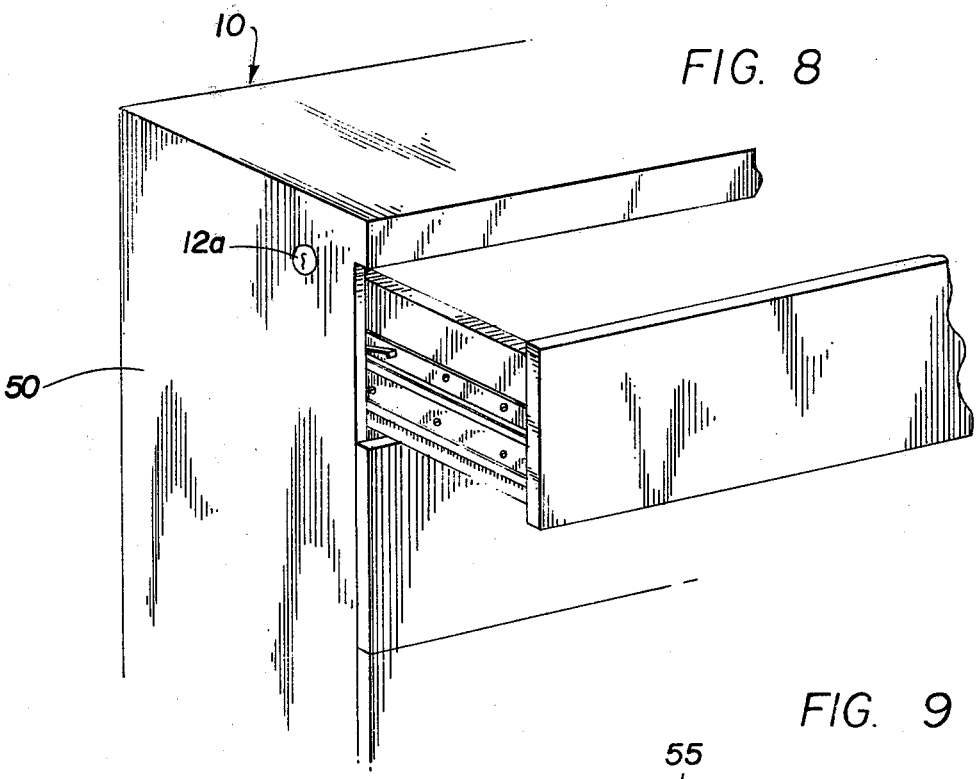
FIG. 8
FIG. 9
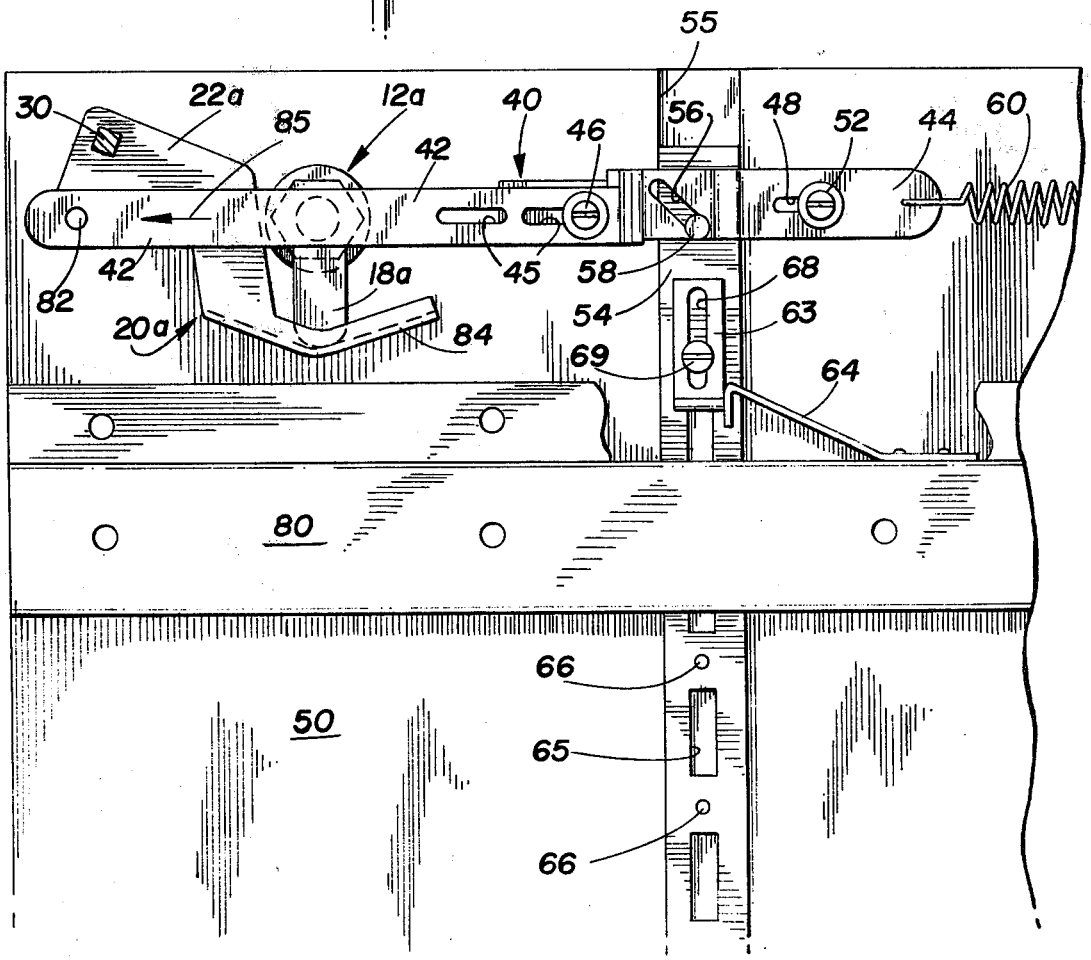

DRAWER-LOCK DEVICE

BACKGROUND OF THE INVENTION

1. Field of the Invention

This invention relates generally to locking devices for drawers associated with file cabinets, desks, credenzas, etc., and more particularly to a locking device that can lock a plurality of drawers from a single actuating point.

2. Description of the Prior Art

As is well known in the art, various problems and difficulties are encountered in providing suitable means for locking and unlocking desk drawers, and other types of drawers in like housings.

Many of the known devices have features that restrict their use with multiple-drawer units. Those devices that are employed with multiple-drawer units are generally complicated to install as well as operate. Thus, they are further expensive to maintain.

There has been a need, especially in the office-furniture industry, to provide devices that simultaneously lock multiple drawers from one activation point only, wherein the activation point can be positioned either in the central portion of the cabinet or on one of the side pedestals thereof. Presently available solutions do not fill the need completely and are generally obtainable in loose-hardware parts which are cumbersome to assembly and install, especially for the production manufacturer of office furniture.

It is also well known that most desk drawers are provided with locks and locking assemblies that operate in such a manner that all of the drawers therein must be unlocked prior to opening a single drawer, and must stay unlocked until that one drawer is closed again. Thus, there is a further need to be able to open a single drawer wherein the remaining drawers do not have to stay unlocked, and wherein the open drawer can be closed and locked after the assembly is in the locked position.

SUMMARY OF THE INVENTION

The present invention comprises a unique drawer-locking device for file cabinets, desks or credenzas that is combined with the use of a single conventional lock mechanism, wherein the lock mechanism can be located in the central portion or to either side of the office furniture piece. The lock location is determined by the design of the particular furniture having the device installed therein.

That is, the lock device may be used with either a right or a left hand desk pedestal, or both, requiring no special tools for installation. It can be further installed in a single drawer unit or a modular construction assembly having a plurality of drawers therein.

The drawer-lock device comprises an actuator positioned so as to be engaged directly with a conventional lock mechanism, wherein the lock mechanism actuates the actuator member which includes a connecting rod that extends laterally to one or both sides, depending upon the location of the drawers to be locked.

At least one free end of the connecting bar is operably connected to a crank arm, whereby the rotation of the connecting bar causes the crank arm to linearly move a slidable spring-loaded lever arm. Vertically supported in the side wall of a drawer unit is a lift-bar member which is operably connected to the lever arm so as to rise and fall during the back-and-forth movement of the slidable lever arm. Adjustably mounted to the lift bar are one or more locking-tab members which are arranged to engage a spring loaded keeper member, the keeper member being affixed to a respective drawer.

OBJECTS AND ADVANTAGES OF THE INVENTION

The present invention has for an important object a provision wherein a conventional lock mechanism can be employed to operate a drawer-lock device wherein the drawer-lock device can be operated from the front, or from either side of the furniture unit having a plurality of drawers—particularly office-type furniture such as desks, file cabinets, credenzas and the like having multi-drawer arrangements.

It is another object of the invention to provide a unique drawer-locking device that allows each drawer to be individually closed while the remaining drawers are locked in a closed position.

It is still another object of the invention to provide a drawer-locking device that includes a positive return mechanism to insure a positive locked/unlocked position for each associated drawer.

It is also another object of the invention to provide a drawer-locking device that includes a plurality of adjustable lock tabs for engagement with respective spring-loaded keeper members which are secured to the sides of the drawers to be locked.

Still another object of the invention is to provide a locking device of this character wherein all of the components are located either above the top drawer or between the sides of the drawer and the sides of the unit, thus allowing full depth utilization of the unit for the drawer itself.

And still another object of the present invention is to provide a locking device of the character that is easy to service and maintain, and that is simple yet rugged in construction.

It is still a further object of the invention to provide a device of this type that is relatively inexpensive to manufacture, and that is simple to install without the use of special tools.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a partial pictorial view of a cabinet structure having a plurality of drawers wherein the present invention is employed therein;

FIG. 2 is a front cross-sectional view showing the locking device in an open position relative to the structure wall and the side wall of a drawer, including a lock mechanism located in the front wall of the drawer;

FIG. 3 is a view similar to that of FIG. 2, wherein the locking device and locking mechanism are shown in a locked position;

FIG. 4 is a perspective view of an actuator member having a portion of the connecting rod disposed therein;

FIG. 5 is a side-elevational view of the actuator member;

FIG. 6 is a bottom plan view thereof;

FIG. 7 is a cross-sectional view taken substantially along line 7—7 of FIG. 2 thereof, wherein the locking device is in a released or unlocked position to allow the keeper member to pass under the locking tab member;

FIG. 8 is a pictorial view similar to FIG. 1 wherein the lock mechanism is positioned to one side of the drawer structure;

FIG. 9 illustrates an alternative arrangement of the actuator member when a lock mechanism is positioned on the side of a drawer structure as in FIG. 8 thereof; and FIG. 10 is a perspective view of a locking-tab member.

DESCRIPTION OF THE PREFERRED EMBODIMENT

Referring more particularly to FIG. 1, there is shown a drawer structure, generally indicated at 10. Drawer structure 10 will herein represent various known drawer structures such as file cabinets, desks, credenzas, and any other like structure or unit having a plurality of drawers slidably disposed therein.

FIG. 1 further illustrates a key-type locking mechanism, generally designated at 12, mounted in the front wall 14 of the top drawer 16 having a locking tongue 18 arranged in a conventional manner. It should be noted that the lock mechanism 12 is also suitable in a desk having a central knee-well drawer, wherein two sets of drawers would be arranged on both sides thereof.

Accordingly, lock mechanism 12 is thus positioned on the cabinet structure 10 to actuate the present invention, depending upon the location of the actuator means (indicated generally at 20). The actuator means in this embodiment comprises a housing 21 having mounting means to be mounted in structure 10. That is, in FIGS. 1, 2 and 3, actuator 20 is mounted to the underside of the top wall 22. This is accomplished by providing extended ears 24 through which screws 26 are located. Movably supported within housing 21 is an actuator arm 28 which is allowed to pivot therein by fixedly mounting the actuator arm 28 to a connecting-rod member 30, wherein the connecting rod is itself rotatably supported in housing 21 by oppositely depending flange members 32 having aligned openings formed therein to receive rod 30, as seen in FIGS. 2 through 6.

Thus, it should be noted that connecting rod 30 can extend laterally in both directions wherein both free ends thereof can be operably attached to the remaining lock assembly, generally indicated at 34. Hence, even though it is not shown, it is well understood that more than one lock assembly 34 can be located along the connecting rod 30 to lock and unlock any number of sets of drawers.

Accordingly, for illustrative purposes only, lock assembly 34 is shown operably connected at one end of the connecting rod 30, wherein the description of one assembly and its operating movements will suffice.

Referring now to FIGS. 2 and 7, the lock mechanism 12 and the lock assembly 34 are shown in an unlocked arrangement, whereby drawer 16 can be pulled out to an open position such as seen in FIG. 2.

The lock assembly 34 comprises a crank-arm member 36 to which one free end 37 of rod 30 is fixedly connected, so as to rotate with rod 30 about its longitudinal axis. As seen in FIG. 2, a support bracket 38 is provided whereby a keeper-spring member 39 is positioned between bracket 38 and crank arm 36 to prevent longitudinal movement of rod 30. Pivotally connected to the lower depending end of crank arm 36 is a spring-loaded lever arm, indicated at 40, which comprises two section members 42 and 44, section members 42 and 44 being adjustable lengthwise to compensate for the various sizes and designs of drawer structures.

Section member 42 is provided with at least one or more elongated slots 45 which allow member 42 to be adjustably secured to member 44 by set screw 46, wherein member 44 also includes a slot 48 so as to provide a means to slidably mount lever arm 40 to the side wall 50 of structure 10, this mounting means being screw 52 secured to wall 50 through slot 48, as seen in FIG. 7.

Thus, it can be seen that any rotational movement (arrow 53) imparted to connecting rod 30 will cause crank arm 36 to rotate, thereby imparting a lateral longitudinal movement to lever arm 40. The longitudinal movement of lever arm 40, in turn, causes interconnected lift-bar member 54 to be raised and lowered within vertical channel 55 formed in side wall 50.

The vertical lift bar 54 is movably connected by a cam action means disposed between the lift bar and the lever arm, the cam-action means comprising an inclined cam slot 56 formed in lever section 44 having a cam pin 58 disposed in same cam slot 56, cam pin 58 being secured to lift bar 54. Thus, as lever arm 40 moves inwardly, as indicated by arrow 59, lift bar 54 is actuated to rise upwardly in channel 55, wherein pin 58 reaches the upper limits of cam slot 56, the inward movement of lever arm 40 being aided by spring means 60, whereby one end of spring 60 is attached to lever arm 40 and the other end thereof is affixed to side wall 50.

Accordingly, there is provided a drawer-keeper means, generally indicated at 62, which is caused to be positioned either in an engaged or disengaged mode, depending upon the above described operation. That is, for every drawer provided in a furniture unit, there is a drawer-keeper means 62 located to lock a respective drawer closed or to allow the drawer to be freely opened, wherein keeper means 62 comprises a locking-tab member 63 and a spring-loaded keeper member 64. Locking tab 63 is vertically mounted to lift bar 54; and the lift bar includes a plurality of vertical slots 65 and interposed threaded holes 66. Thus, each tab member 63 is provided with an elongated slot 68 through which screw 69 passes and is received in hole 66 of bar 54. Tab 63 is also provided with an extended lip 70 located to be received in bar slot 65, whereby locking tab 63 can be positioned on lift bar 54 so as to be located adjacent a respective keeper member 64, wherein the forward tongue member 72 of tab 63 can engage the depending leg member 74, as seen in FIGS. 3 and 9. FIGS. 2 and 7 show tab 63 located above keeper 64, thus allowing drawer 16 to be opened whereby tongue 72 is disengaged from leg member 74.

Accordingly, when lock 12 is operated to a locked position whereby lock tongue 12 engages and actuates arm 28, connecting rod 30 rotates clockwise, as indicated by arrow 53—then, in turn, rotates crank arm 36, thus pulling lever arm 40 forwardly against the force of spring 60. During the forward movement of lever arm 40, lift bar 54 is moved downwardly in channel 55 by the action of cam slot 56 reacting against cam pin 58; and, thus, tab 63 moves into engaging alignment with spring-loaded keeper 64, whereby the drawer is prevented from opening. However, it should be noted that, if the locking mode is established while any of the drawers are in an open mode, they can be simply closed and locked by closing the drawer, thus allowing the tab tongue 72 to ride over the spring-loaded keeper member. Once the tab passes over keeper 64, the keeper will again be positioned to abut against tab 63.

It should be further noted that keeper 64 can be mounted directly to the side of any drawer, or to a slide mechanism 80, as seen in the figures of the accompanying drawings.

Referring now to FIGS. 8 and 9, there is shown an alternative arrangement of an actuator means which is designed to operate in combination with a side-positioned lock mechanism such as 12*a*. That is, lock 12*a* is located in the side wall 50 of unit 10, whereby the locking tongue 18*a* directly engages the actuator means 20*a*. In this arrangement, actuator means 20*a* comprises a bell-crank member 22*a* fixedly secured to one end of the connecting rod 30 so as to rotate therewith. The front section 42 of lever arm 40 is pivotally connected at 82 to the forward portion of bell-crank member 22*a* so as to laterally move therewith. However, the rearward portion of crank member 22*a* is formed having an actuator-strut member 84 adapted to be engaged by lock tongue 18*a* when in a locked position, as seen in FIG. 9.

Thus as tongue 18*a* is rotated to a locked position (FIG. 9), it engages strut 84, causing bell crank to rotate, thus moving lever arm 40 forwardly (indicated by arrow 85) and forcing pin 58 to move downwardly against the force of cam slot 56, whereby lift bar 54 is moved downwardly to engage tab 63 with keeper 64.

However, when lock tongue 18*a* is returned to an unlocked position, the retracting force of spring 60 again pulls lever 40 rearwardly, causing lift bar and its associated tab members to lift upwardly, thus releasing keeper 64 and its associated drawer.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A drawer-lock device to be employed with a single or multi-drawer unit having a conventional lock mechanism associated therewith to activate said drawer lock device to an open or closed mode, wherein said device comprises:

an actuator means engagably positioned to be activated by said lock mechanism;

a connecting rod mounted to said actuator means wherein the movement of said actuator means causes said connecting rod to rotate about its longitudinal axis;

a spring-biased lever arm operably connected to said connecting rod and slidably mounted to the drawer unit, whereby the rotation of said connecting rod is transferred into the linear movement of said lever arm;

means to slidably mount said lever arm to said unit;

spring-biasing means attached between said lever arm and said unit to provide linear movement of said lever in one direction;

a lift bar positioned perpendicularly to said lever arm and coupled thereto, whereby the linear movement of said lever arm causes longitudinal movement of said lift bar; and drawer-keeper means interposed between said lift bar and a drawer, or drawers, within said drawer unit to prevent said drawer from opening when in a locked mode, but allowing said drawer to close in a locked mode.

2. A drawer-lock device as recited in claim 1, wherein there is included a cam-action means coupling said lever arm to said lift bar to allow an associated movement therebetween.

3. A drawer-lock device as recited in claim 2, wherein a crank arm is interconnected between said connecting rod and said spring-biased lever arm whereby said crank arm is affixed to said connecting arm to rotate therewith.

4. A drawer-lock device as recited in claim 2, wherein said drawer-keeper means comprises:

a flexible keeper member adapted to be attached to a drawer; and a locking-tab member adjustably mounted to said lift bar whereby said tab is positioned for locking engagement with said flexible keeper member.

5. A drawer device as recited in claim 2, wherein said cam-action means comprises:

an inclined slot formed in said lever arm; and a cam pin affixed to said lift bar and slidably received in said inclined slot, whereby the lateral movement of said lever arm causes perpendicular movement in said lift bar relative to said lever arm.

6. A drawer-lock device as recited in claim 4, wherein said flexible keeper member is mounted to a drawer-slide mechanism attached to said drawer.

7. A drawer-lock device as recited in claim 4, wherein said spring-biased lever arm includes means for adjusting the length of said lever arm to accommodate various sizes of drawer units and the respective drawers therein.

8. A drawer-lock device as recited in claim 7, wherein said lever-arm-adjusting means comprises:

a first forward section having at least one longitudinal slot formed therein;

a second rearward section adjustably connected to said first forward section, wherein the two sections define said lever arm; and a mounting screw received through said slot of said first section and affixed into said second section, said first section being operably attached at one end to said actuator means, and wherein one end of said second section is attached to said spring biasing means.

9. A drawer-lock device as recited in claim 7, wherein said actuator means is mounted and located along the front portion of said drawer unit and comprises:

a housing having depending flange members to rotatably receive said connecting rod therein; and an actuating-arm member fixedly attached to said connecting rod to cause rotational movement of said connecting rod when said locking mechanism engages said actuator-arm member.

10. A drawer-lock device as recited in claim 8, wherein said actuator means is mounted and located to one side of said drawer unit and comprises:

a bell-crank member that is fixedly connected to said connecting rod to rotate therewith and pivotally connect to said first section of said spring-biased lever arm; and an actuator-strut member adapted to be engaged by said lock mechanism mounted to one side of said drawer unit.

11. A drawer-lock device as recited in claim 8, wherein said lift-bar member is slidably received in an elongated perpendicular channel formed in the side of said drawer unit.

12. A drawer-lock device as recited in claim 1, wherein said actuator means is mounted and located along the front portion of said drawer unit and comprises:

a housing having depending flange members to rotatably receive said connecting rod therein; and an acutator-arm member fixedly attached to said connecting rod to cause rotational movement of said connecting rod when said locking mechanism engages said actuator arm member.

13. A drawer-lock device as recited in claim 12, wherein there is included a cam-action means interconnecting said spring-biased lever arm to said lift bar to cause the horizontal linear movement of said lever arm to be transferred into the perpendicular movement of said lift bar.

14. A drawer-lock device as recited in claim 13, wherein said cam-action means comprises:

an inclined slot formed in said lever arm; and a cam pin affixed to said lift bar and slidably received in said inclined slot, whereby the lateral movement of said lever arm causes perpendicular movement to said lift bar relative to said lever arm.

15. A drawer-lock device as recited in claim 1, wherein said actuator means is mounted and located to one side of said drawer unit and comprises:

a bell-crank member that is fixedly connected to said connecting rod to rotate therewith and pivotally connect to said spring-biased lever arm; and an actuator-strut member adapted to be engaged by said lock mechanism mounted to one side of said drawer unit.

* * * * *